United States Patent [19]

Boisture et al.

[11] Patent Number: 5,002,120

[45] Date of Patent: Mar. 26, 1991

[54] MULTI-LANCE TUBE CLEANING SYSTEM

[76] Inventors: Thomas B. Boisture, 4614 St. Andrews, Baytown, Tex. 77521; Larry D. McGrew, Rte. 5, Box 548C, Cleveland, Tex. 77327; James D. Jeffrey, 3410 Fleming, Baytown, Tex. 77521; Gene P. Livingston, Pleasant Hill, Calif.

[21] Appl. No.: 490,776

[22] Filed: Mar. 8, 1990

[51] Int. Cl.[5] ..... F28G 1/00

[52] U.S. Cl. ..... 165/95; 15/316 R; 122/391; 134/166 C

[58] Field of Search ..... 122/379, 391, 392; 165/95; 15/316 R, 316 A, 317; 134/166 C, 167 C, 56 R

[56] References Cited

U.S. PATENT DOCUMENTS

| | | | |
|---|---|---|---|
| 620,224 | 2/1899 | Bubser . | |
| 1,694,371 | 12/1928 | Burdick | 15/104.05 |
| 1,796,878 | 3/1931 | Watson | 134/24 |
| 2,494,380 | 1/1950 | Ellig | 134/168 |
| 2,604,358 | 7/1952 | Richards | 299/47 |
| 3,269,659 | 8/1966 | Shelton et al. | 239/187 |
| 3,589,388 | 6/1971 | Haneline, Jr. | 137/315 |
| 3,600,225 | 8/1971 | Parmelee | 134/24 |
| 3,794,051 | 2/1974 | Lee, Jr. et al. | 134/46 |
| 3,817,262 | 6/1974 | Caradeur et al. | 134/167 |
| 3,901,252 | 8/1975 | Riebe | 134/56 |
| 3,903,912 | 9/1975 | Ice, Jr. et al. | 134/167 |
| 3,938,535 | 2/1976 | Cradeur et al. | 134/167 |
| 4,095,305 | 6/1978 | Goodwin | 15/104.1 |
| 4,107,001 | 8/1978 | Kinzler | 202/241 |
| 4,199,837 | 4/1980 | Fisco, Jr. | 15/302 |
| 4,234,980 | 11/1980 | Divito et al. | 15/302 |
| 4,322,868 | 4/1982 | Wurster | 15/302 |
| 4,422,210 | 12/1983 | Bergsand et al. | 15/302 |
| 4,503,811 | 3/1983 | Hammond | 122/392 |
| 4,543,711 | 10/1985 | Wada et al. | 29/726 |
| 4,547,963 | 10/1985 | Ohmstede | 29/726 |
| 4,669,145 | 6/1987 | Kehr | 134/166 C |
| 4,750,547 | 6/1988 | Sakamoto | 165/95 X |
| 4,805,653 | 2/1989 | Krajicek et al. | 134/166 C |
| 4,856,545 | 8/1989 | Krajicek et al. | 134/166 |

OTHER PUBLICATIONS

Single and Multi Rotating Lance Bundle Cleaner Drawings: Hydrovac Industrial and Chemical Services, Ltd. 1/22/88, 2/2/88, 4/2/88.

Dow Sales Brochure for Jet-Cleaning Heat Exchanger Tubes with Mini-Lancer Service.

Weatherford Water Jetting Systems, Heat Exchanger Tube Lancing Machine, 1988.

Hydrovac International, Ltd., Sales Brochure, Date Unknown.

Browning Ferris Industries Chemical Services, Inc., No Date pp. RC 1007-1009, Date Unknown.

1971 Cesco, Inc. Annual Report, pp. 8-9.

Cesco, Inc. Sales Brochure, Date Unknown.

Cesco Scene, Cesco, Inc., Company Newsletter, pp. RC-1058, Date Unknown.

R. Lee, R. Torbin, R. Bell, "State of the Art Mechanical Cleaning Heat Exchangers," Oct. 1985, American Society of Mechanical Engineers, pp. 7-8.

J. Twigg, "High-Pressure Water Jetting Techniques," Corrosion Prevention and Control, Apr. 1982.

*Primary Examiner*—Edward G. Favors

*Attorney, Agent, or Firm*—Pravel, Gambrell, Hewitt, Kimball & Krieger

[57] ABSTRACT

A multi-lance cleaning apparatus for cleaning the interior of heat exchanger tubes, the apparatus having a lance housing, a slidable manifold within the lance housing, a single conduit connecting the manifold with a high pressure, high volume fluid source, a spool for storing the conduit permitting it to be advanced and retracted, means for moving the manifold within the housing, a plurality of lances removably attached to the manifold and adapted to fit within a heat exchanger tube and tube guides to guide and support the lances. The apparatus further includes a means for positioning the housing with respect to a heat exchanger tube bundle to be cleaned.

21 Claims, 8 Drawing Sheets

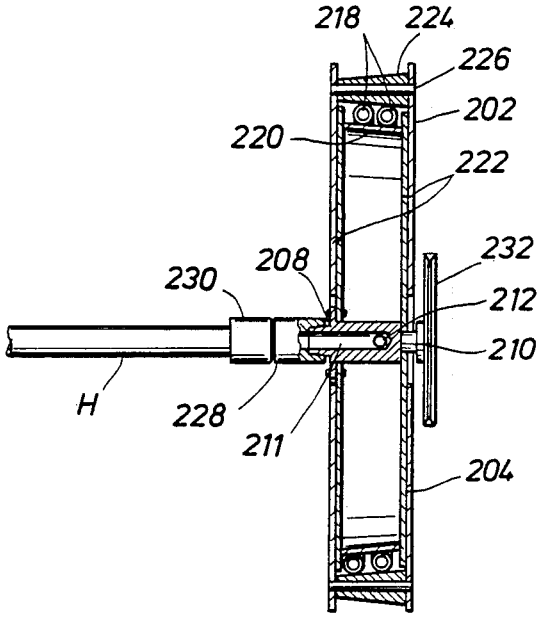
FIG. 12
FIG. 13
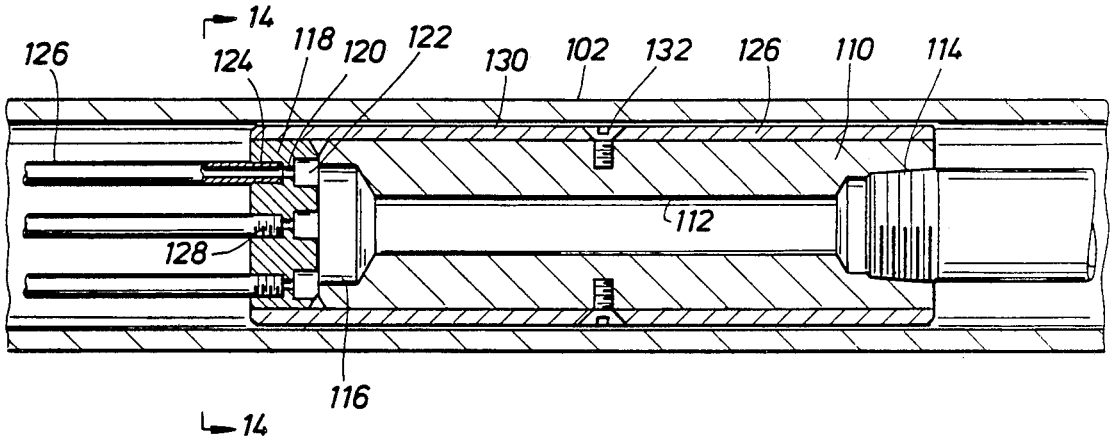
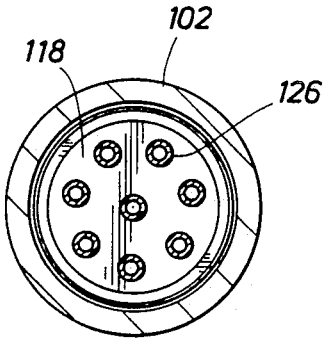
FIG. 14

FIG. 17
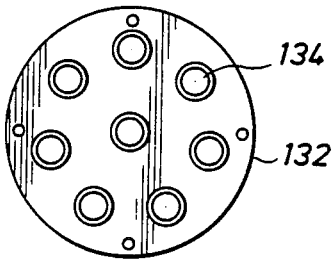
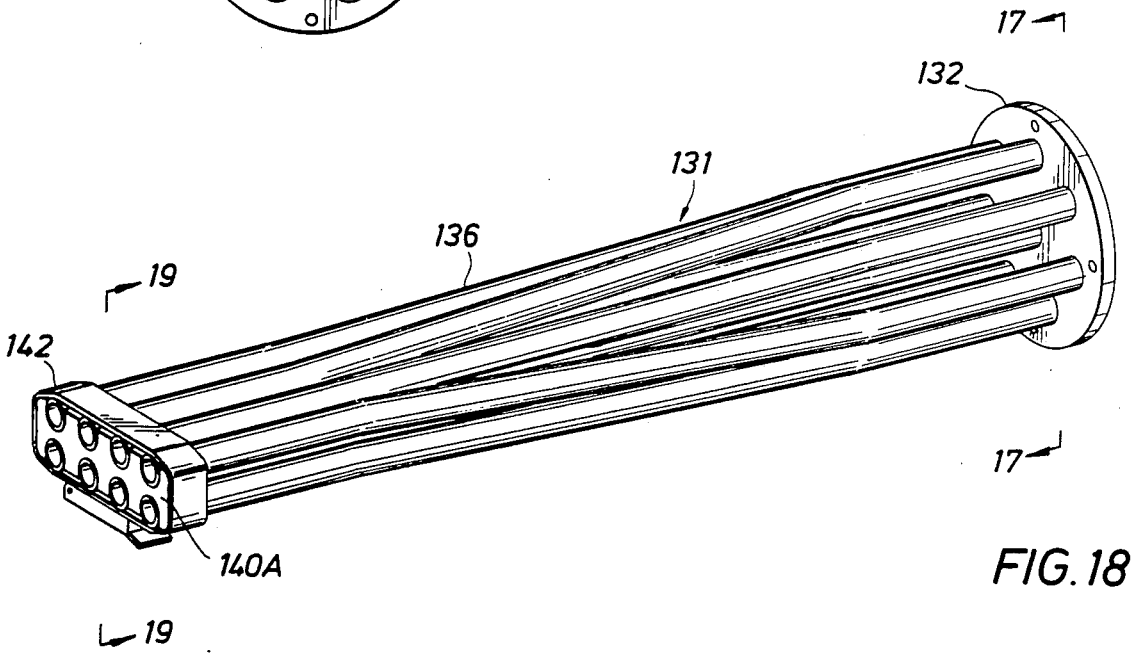
FIG. 18
FIG. 19
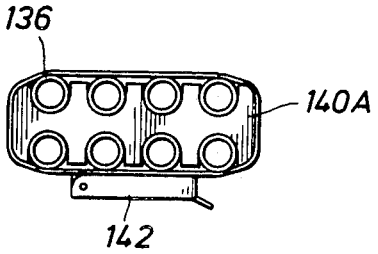
FIG. 20
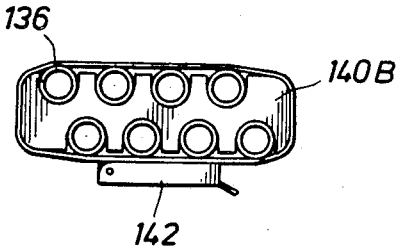

MULTI-LANCE TUBE CLEANING SYSTEM

BACKGROUND OF THE INVENTION

1. Field of the Invention

The present invention relates to an apparatus for cleaning the interior of tubes used in heat exchanger bundles. More particularly, the present invention relates to an apparatus for simultaneously cleaning the interior of several tubes within a heat exchanger bundle on site.

2. Background of the Invention

Heat exchanger tube bundles are used for the transfer of heat from a fluid media passing through a series of conduits. During this process, carbonaceous and calcareous deposits will form on the interior of the individual tubes and debris and other dirt will collect on the surface of the individual tubes. Therefore, in order to maintain efficient operation, it is necessary to periodically remove the tube bundles and clean the interior and exterior of the tubes.

One method of cleaning the interior of heat exchanger tubes includes the progressive insertion of a small diameter tube, known as a lance, into the heat exchanger tube and pumping high pressure water through the lance to clean the interior of the tube. The water pressure in a lance may easily exceed 10,000 psi and flow rates in excess of 100 gallons per minute. Prior art devices called for the lance to be manually operated and advanced into the exchanger tube. It will be appreciated that the manual operation of a lance is unsatisfactory for a number of reasons. First, the operator is required to overcome the force of the water pressure when inserting the lance into the tube. Further, should the lance wall rupture, an operator may be injured by the high pressure water flow. Similarly, an operator may be injured by back-splash from the lance during the insertion of the lance in the tube. Lastly, the manual operation of a lance is time consuming and costly as only one lance may be used in manual operations.

Various mechanical devices have been used in an effort to overcome the above deficiencies in cleaning the interior of heat exchanger tubes. U.S. Pat. No. 3,903,912 to Ice, et al. discloses a multiple lance cleaning system, including lance positioning and drive means and exposed lance tubes. However, the use of exposed lance tubes continues to pose a danger to an operator should a lance wall rupture. U.S. Pat. No. 3,817,262 to Caradeur also discloses a multiple lance cleaning system having a lance positioner and drive system and exposed lance tubes. However, as in the Ice disclosure, the operator is still exposed to the danger of potential lance tube rupture.

U.S. Pat. No. 3,901,252 to Riebe discloses a multiple lance system including a lance drive and enclosed lance tubes, manifold and water lines. However, Riebe does not disclose a lance positioning system capable of readily positioning the lances and lance drive into a multitude of tubes within the heat exchanger bundle nor does it disclose a system for retracting the water pressure line. U.S. Pat. No. 4,856,545 to Krajicek disclosed a multi-lance tube cleaning system having a lance drive means, lance tubes and manifold and multiple high pressure water lines within an enclosed structure. The disclosure called for the cleaning structure to be positioned by a crane mounted on a truck or by other mobile crane, tractor or skid. However, there are a number of disadvantages, i.e., as the lances are moved forward the center of gravity of the structure may shift which could result in misalignment and unnecessary stress on the lance tubes.

Accordingly, there exists a need for an improved tube bundle cleaner having enclosed tube lances, means for transporting water to the lances and for accurately supporting and positioning the lances during operation, and means for retracting the water pressure line in an efficient and thorough manner. While there are other disclosures directed to the cleaning of the interior of heat exchanger bundles (such as U.S. Pat. Nos. 3,589,388; 2,494,380; 1,694,371; and 620,224), none disclose or suggest a multi-lance cleaning system having enclosed lances, manifold and an independent means for positioning the lance cleaning system.

SUMMARY OF THE INVENTION

The present invention relates to a multi-lance apparatus for cleaning the interior of tubes within a heat exchanger tube bundle having an elongate housing, a moveable high pressure water manifold within the housing, a single conduit connecting the manifold to a high pressure high volume water source and means for storing the conduit. The apparatus further includes a plurality of lances removably connected to the manifold, means for moving the manifold within the housing and means for supporting and guiding the lance tubes during operations and storage. The present invention also includes a means for positioning and supporting the housing with respect to a tube bundle to be cleaned.

BRIEF DESCRIPTION OF THE DRAWINGS

In order to more fully understand the drawings used in the detail description of the present invention, a brief description of each drawing is presented.

FIG. 12 is a cross-sectional view taken along line 12—12 of FIG. 11 showing the spool portion of the preferred embodiment.

FIG. 13 is a cross-sectional view of the manifold portion of the preferred embodiment.

FIG. 14 is an end view of the manifold portion of the preferred embodiment.

FIG. 17 is an end view of the indexing assembly and guide tubes of the present invention.

FIG. 18 is a perspective view of the indexing assembly of the present invention.

FIG. 19 is an end view of a square forward guide plate in the indexing assembly of the present invention.

FIG. 20 is an end view of a triangular forward guide plate in the indexing assembly of the present invention.

DETAILED DESCRIPTION OF THE INVENTION

Figure 1:
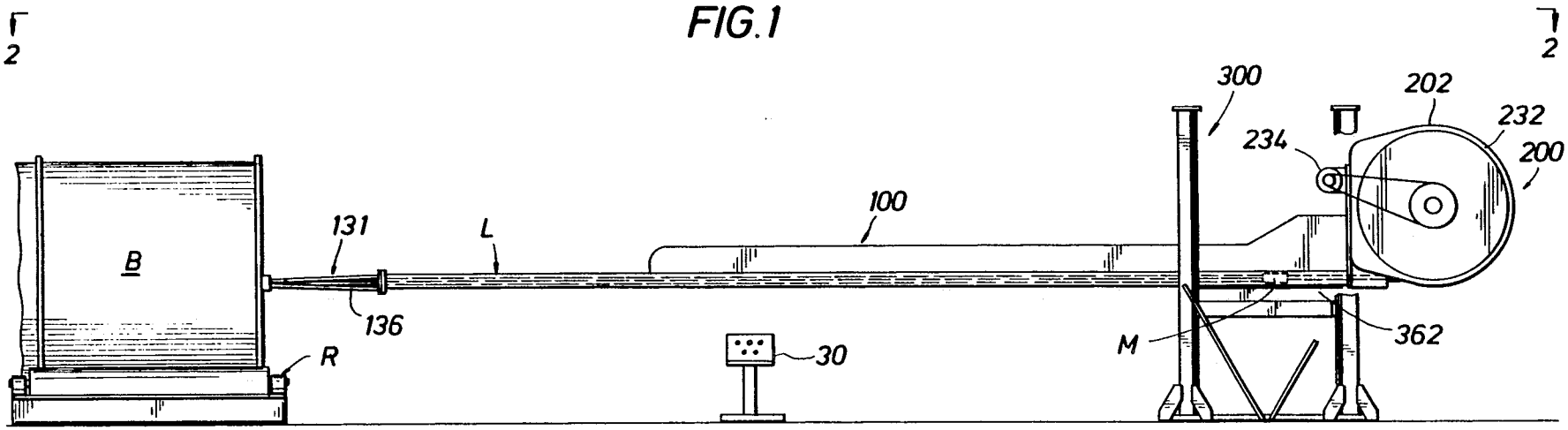
FIG. 1 is an elevational view of the preferred embodiment.
Figure 2:
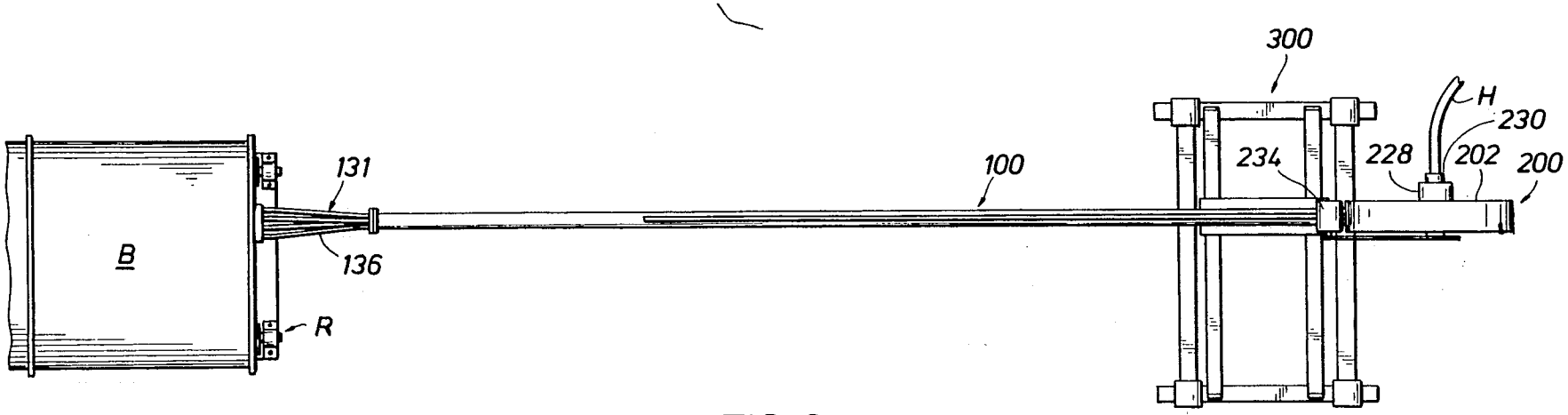
FIG. 2 is a top view of the preferred embodiment.

FIGS. 1 and 2 are side and top views of the preferred embodiment of the invention. A tube bundle "B" is disposed on rollers which are part of a tube bundle support and rotating device "R." The device "R" is disclosed in pending U.S. patent application No. 07/489,001 filed 3/6/90 . Lance assembly 100 is shown in close proximity to tube bundle "B." A plurality of hollow, high strength lances "L" are generally shown as being disposed in the lance assembly 100. A lance indexing assembly 131 is shown affixed to the end of the lance assembly 100, adjacent to the tube bundle "B." Further, the lances "L" are shown as being in communication with a manifold "M" within the lance assembly 100. Spool assembly 200 is removably attached and in close proximity to lance assembly 100. The spool assembly is used to store a high pressure flexible water line (218 in FIG. 10) which is in communication with manifold "M" in lance assembly 100. The spool assembly is itself connected to a high pressure, high volume water source by means of hose "H" as shown in FIG. 2. The lance assembly 100 and the spool assembly are supported by a positioner assembly 300 which supports and positions the lance assembly 100 and spool assembly 200 relative to the tube bundle "B" to be cleaned. The positioner 300 is capable of moving the lance assembly 100 and spool assembly 200 horizontally (or laterally) and vertically. Also shown in FIG. 1 is a remote control pendant 30. The control pendant 30 is intended to control a high pressure water source and hydraulic fluid flow used to position and power the present invention. While the remote control pendant may be configured to control any suitable high pressure water source and hydraulic flow, it is contemplated that the present invention, including the remote control pendant 30 has been specifically configured to operate with the high pressure water source and hydraulic pressure source described in application No. 07/489,001, herein after referred to as the "water pressurizing unit." Further, the control pendant 30 in the present invention is interconnected with the positioning and spool assemblies 300 and 200 in a like manner as the remote control pendant described in application No. 07/489,001.

Figure 4:
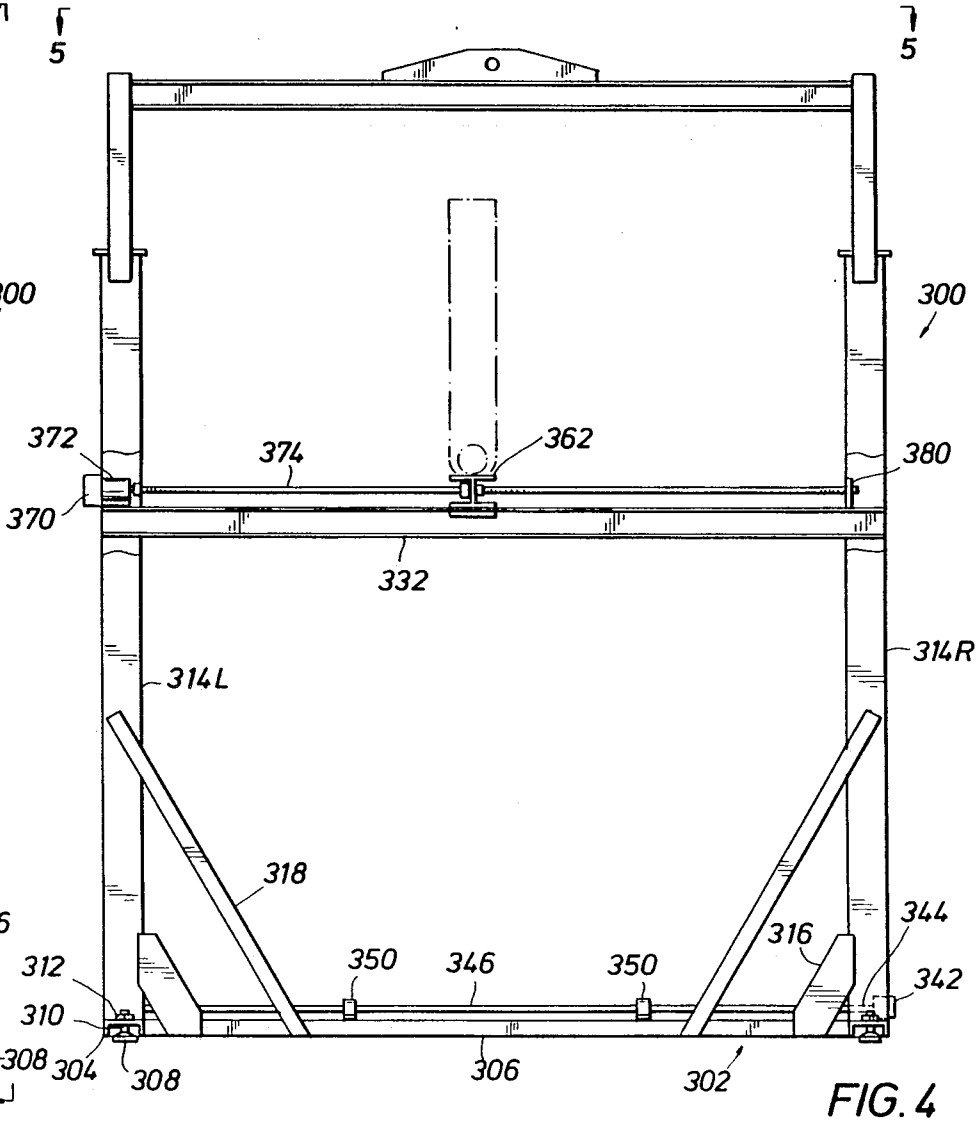
FIG. 4 is a front view partly in section of a portion of the present invention.
Figure 3:
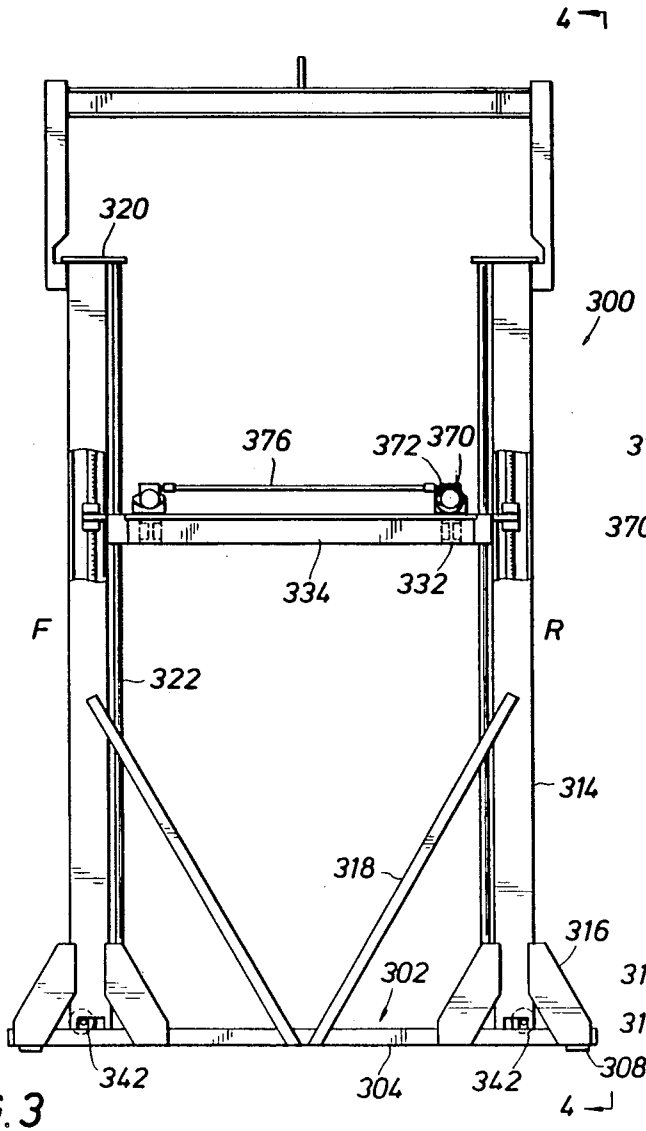
FIG. 3 is an end view partly in section of a portion of the present invention.

Referring to FIGS. 3 and 4, the positioning assembly 300 is comprised of a generally rectangular base frame 302. Preferably, the base 302 is formed from metal channel members 304 and 306. Members 304 make up the side base channels and members 306 make up the front and rear members of the base 302. Base members 304 and 306 may be connected using mechanical means, such as nuts and bolts.

Figure 5:
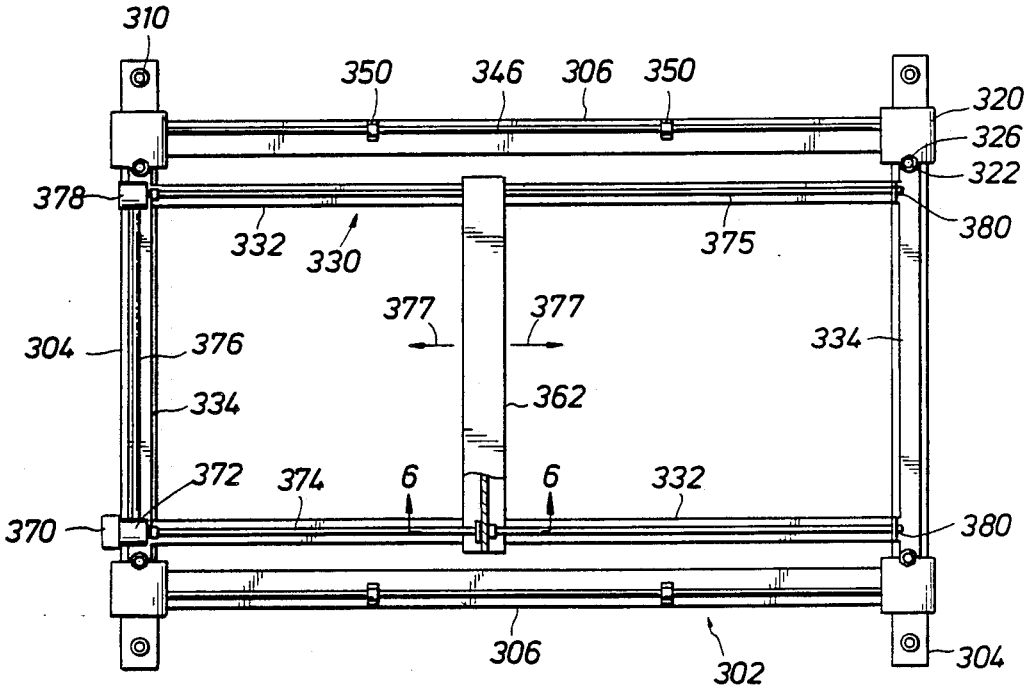
FIG. 5 is a top view partly in section of a portion of the present invention.

Referring to FIG. 5, base members 304 extend past base members 306. The extra length of base members 304 provides an attachment point for flared leveling feet 308. A more detailed view of leveling feet 308 may be obtained from FIG. 8. The feet 308 have a threaded shaft 310 attached to the upper end of said feet 308. Preferably, the leveling feet 308 and shaft 310 are a unitary body. The shaft 310 extends upward through a hole in base member 304 and is threaded into nut 312 affixed to base member 304.

Figure 8:
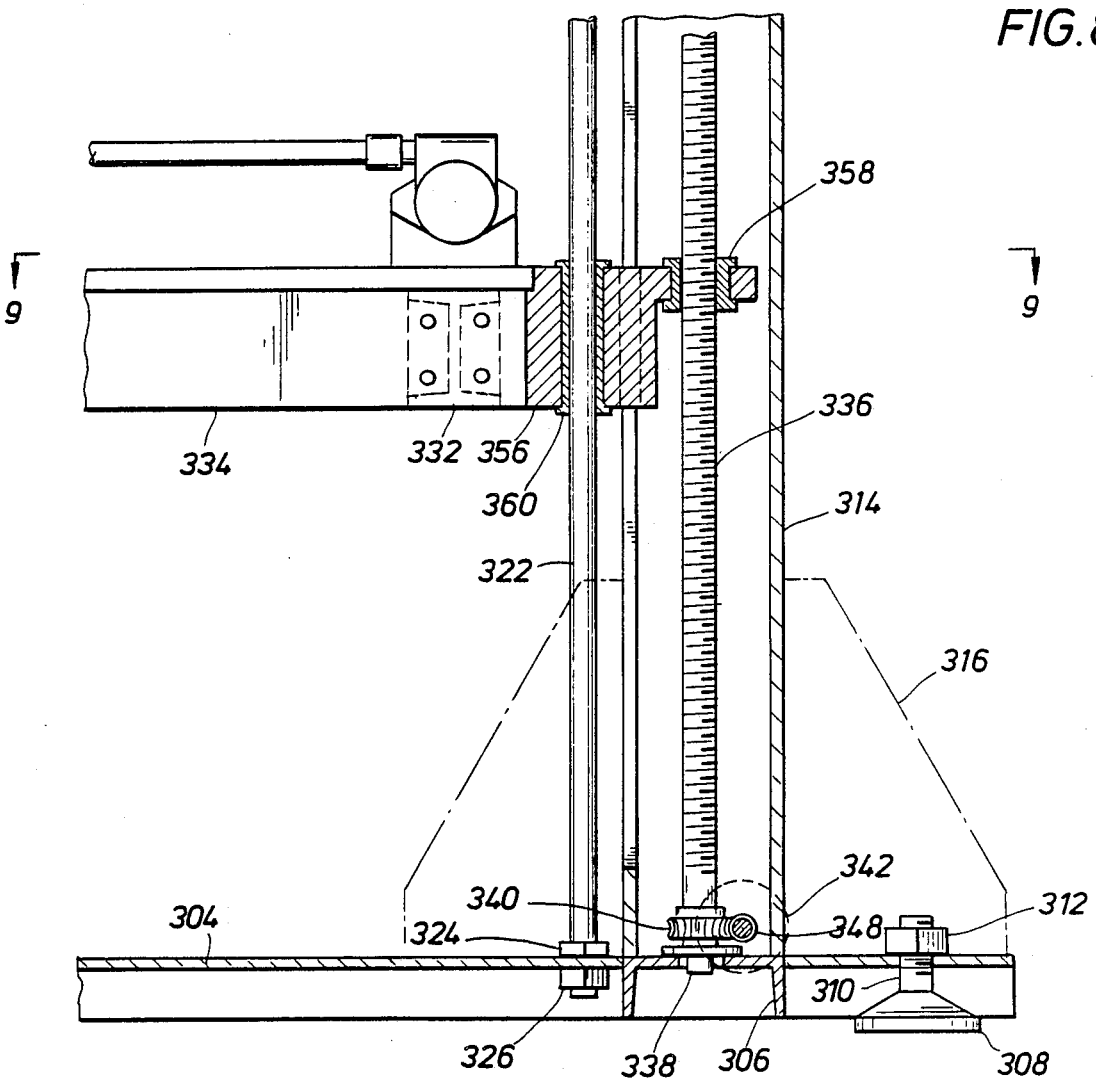
FIG. 8 is a detailed elevational view partly in section of the vertical transport mechanism of the present invention.

Referring again to FIGS. 3 and 4, affixed to base 302 are four vertical frame members 314. Generally, the vertical members 314 are of a box construction. A plurality of gussets 316 and cross braces 318 are attached to base 302 and vertical members 314 to provide additional stiffness and rigidity to the positioning assembly 300. A vertical cap 320 of a rectangular shape is affixed to the top of each vertical member 314. Four vertical guide shafts 322 are mounted in proximity to vertical members 314. Referring now to FIG. 8, the guide shafts 322 are threaded on each end and removably fixed to base 302 by nuts 324/326.

Referring still to FIGS. 3, 4 and 5, a generally rectangular guide frame 330, comprised of I-beam members 332 and 334, is provided to assist in vertically positioning the cleaning apparatus of the present invention with respect to tube bundle "B" as shown in FIG. 1.

Figure 9:
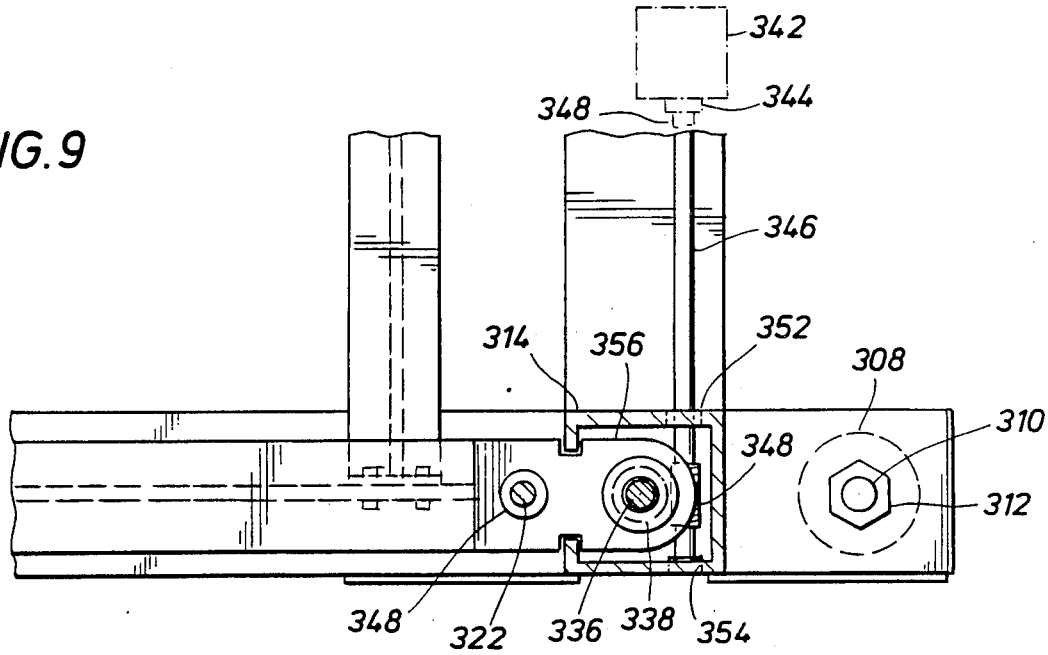
FIG. 9 is a detailed sectional view taken along line 9—9 of FIG. 8 showing the vertical transport mechanism of the present invention.

Referring back to FIG. 8 and also FIG. 9, a threaded shaft 336 is mounted in each of the vertical members 314. The shaft 336 thread may be an acme or other suitable thrust bearing thread. The shaft 336 is supported and retained by bearing 338 affixed to the frame 302 and by similar bearings mounted in vertical caps 320 (not shown). Affixed to the bottom of shaft 336 is a worm gear follower 340. The shaft 336 is rotated by a hydraulic motor 342 as shown by phantom lines. The hydraulic motor 342 output shaft 344 is coupled to a drive shaft 346. Mounted on drive shaft 346 are two worm gears 348. The worm gears 348 engages worm gear followers 340 mounted on threaded shafts 336. The drive shaft 346 runs the length of base member 306 and is supported and retained by bearing blocks 350 (FIG. 4) and bushing 352 (FIG. 9) which is mounted on the inside face of vertical member 314, and bearing 354 which is mounted in the outside face of vertical member 314. As may be seen in FIG. 3, two motors 342, shown in phantom, are mounted at the front "F" and rear "R" of positioning assembly 300.

With reference to FIGS. 4, 8 and 9, the rotational output of motor 342 is coupled to drive shaft 346. The worm gears 348 mounted on drive shaft 346 are in rotational contact with worm gear followers 340 and thereby rotate threaded shafts 336.

Affixed to guide frame 330 at each corner are guide carriages 356. As may be seen in FIG. 9, guide carriage 356 is adapted to fit within vertical member 314 through an open channel in vertical member 314. Referring again to FIG. 8, a threaded nut 358 adapted to mate with threaded shaft 336 is mounted on guide carriage 356. In the illustrated embodiment, threaded nut 358 is depicted as a separate entity. However, it is understood that a female threaded adapted to mate with threaded shaft 336 may be machined directly into guide carriage 356. Guide carriage 356 is also in slidable contact with vertical shafts 322. As shown in FIG. 8, the vertical shaft 322 passes through a hole in guide carriage 356 in which is mounted a nylon guide bushing 360. It is understood that other suitable materials, such as brass, may be used to form guide bushing 360.

Thus, the rotational output of hydraulic motors 342 rotates drive shafts 346 and worm gears 348, which, in turn rotate threaded shafts 336. The guide frame 330 is thus positioned vertically as it moves in response to the rotation of threaded shaft 336 by means of threaded nut 358. Further, the vertical shafts 322 provide additional stability to the movement of guide frame 330.

Figure 6:
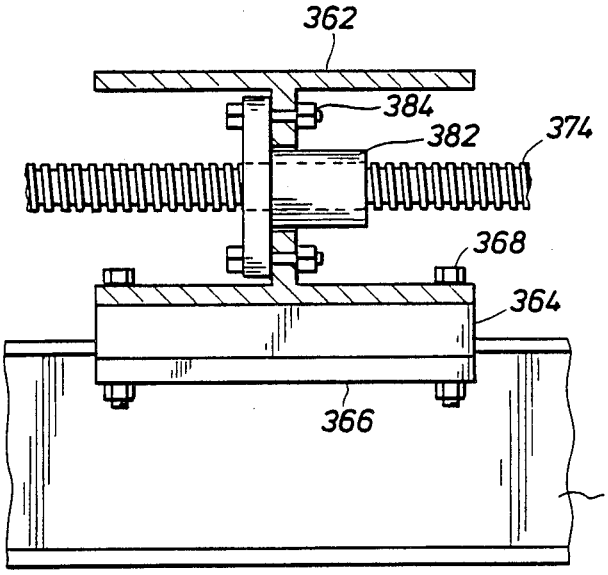
FIG. 6 is a detailed sectional view taken along line 6—6 of FIG. 5 showing the lateral transport mechanism of the present invention.
Figure 7:
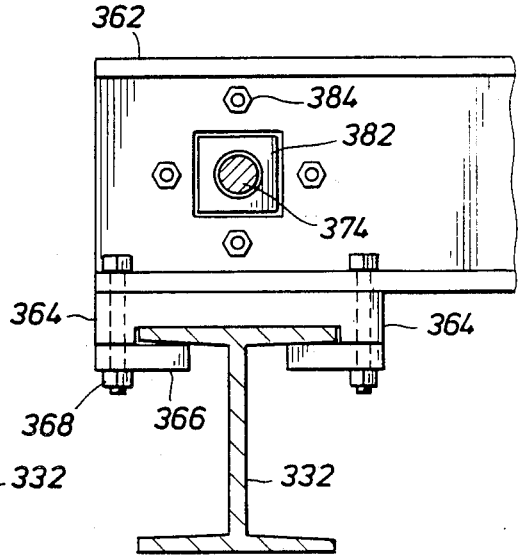
FIG. 7 is a detailed sectional view taken along line 7—7 of FIG. 6 showing the lateral transport mechanism of the present invention.

Referring now to FIGS. 5, 6 and 7, a lateral positioning means is adapted to be mounted on guide frame 300. A carrier beam 362 is adapted to be slidably mounted on guide frame members 332. The carrier beam 362 is adapted to be removably connected to a carrier block 364, which may be manufactured from nylon or other suitable material having a sufficiently low coefficient of friction. As may be seen in FIG. 7, the carrier block 364 is adapted to rest on the top flange of guide frame member 332. Carrier retainers 366 are adapted to be removably attached to carrier block 364 and are in close proximity to the inside face of the top flange of frame member 332. The carrier block 364 and carrier retainers 366 are adapted to mate with carrier beam 362 by means of nuts and bolts 368. The carrier beam 362 is thus retained in close slidable contact with frame member 332. Further, the carrier blocks 364 and retainers 366 may be readily serviced or replaced when they become worn.

Referring now to FIG. 5, a hydraulic motor 370 is mounted on frame member 334. The motor 370 is coupled to a gear box 372 which transfers the output to threaded shaft 374 and threaded shaft 376 which is substantially at a right angle to shaft 374. The thread on shaft 374 may be an acme or other suitable thrust bearing thread. Shaft 376 is in turn coupled to a second gear box 378, which transfers the rotation of shaft 376 substantially ninety degrees to a second threaded shaft 375. Threaded shafts 374 are supported at their distal ends by bearing blocks 380 affixed to frame member 334. Threaded nuts 382 having a thread mating the thread of shafts 374 and 375 are affixed to the web of carriage beam 362 in proximity to its distal ends, threaded shafts 374/375 passing therethrough. In the illustrated embodiment, threaded nuts 382 are shown to be adapted to fit within and be affixed to carriage beam 362 by means of nuts and bolts 384. However, it may be understood that a threaded nut 382 of different configuration may be affixed to carriage beam 362 by other means. The output of motor 370 thus drives threaded shafts 374/375 causing carriage beam 362 to move laterally along frame member 332 in the direction of arrows 377. Accordingly, it will be appreciated that the positioning assembly is capable of positioning carriage beam 362 horizontally with respect to a tube bundle "B" as shown in FIGS. 1 and 2. Further guide frame 330 and carriage beam 362 operate to position the lance 100 and spool 200 assemblies horizontally and vertically.

Figures 10, 11:
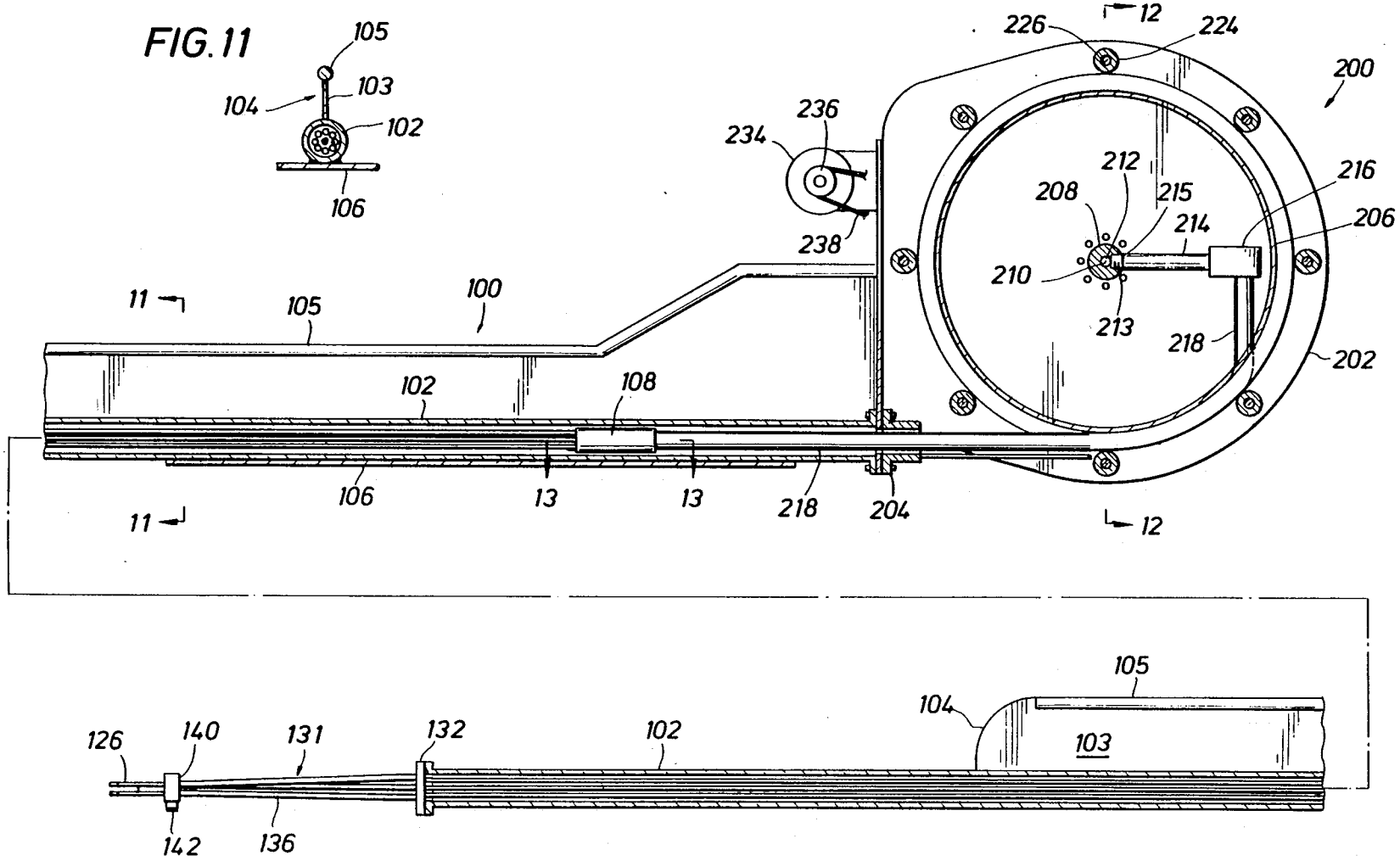
FIG. 10 is a cross-sectional view of the tube cleaning apparatus and spool portion of the preferred embodiment.
FIG. 11 is a cross-sectional view taken along line 11—11 of FIG. 10 showing the tube cleaning apparatus of the preferred embodiment.

Referring to FIG. 10, lance assembly 100 and spool assembly 200 are shown. With reference to lance assembly 100, a hollow elongate housing 102 is affixed to a shorter base 104 which comprises a web 103 and a top 105. In the preferred embodiment, cross-sectional housing 102 is shown as cylindrical in cross-section (See FIG. 11). However, it is understood that the cross-section of housing 102 may vary without departing from the spirit of the invention. In the preferred embodiment, base 104 is shown as being welded to housing 102. Base 104 is adapted to be removably attached to carriage beam 362, depicted in FIG. 1. The base 104 may be attached to carriage beam by means of nuts and bolts, latches or other suitable mechanical means.

An elongate support member 106 is affixed to housing 102 opposite base 104. Support member 106 rests on carriage beam 362. A manifold 108 is slidably mounted in housing 102.

Referring to FIG. 13, manifold 108 is comprised of a central metal body 110 having an axial bore 112 therethrough. One end of bore 112 is adapted to be removably connected to a high pressure water line. It is understood that any references to water as a high pressure cleaning fluid is meant to include water, a cleaning fluid, or any soluble combination thereof. All further references to water are meant to include such cleaning fluids. Body 110 includes a sealing thread 114 in the central bore 112. Opposite the threaded end of body 110, a coaxial counterbore 116 is machined in bore 112. A lance plate 118 is mounted adjacent to the machined counterbore 116 and in sealing contact with body 110. Lance plate 118 may be maintained adjacent to manifold body 110 by means of drilled and tapped holes or other suitable mechanical means. Lance plate 118 includes a plurality of apertures 120 passing therethrough and a plurality of counterbores 122 adjacent to body 110. The lance plate counterbores 122 are adapted to mate with the counterbore 116 in body 110 such that the lance plate holes 120 are in fluid communication with manifold central bore 112. The lance plate 118 further includes internal threads 124 adapted to receive lances 126 and mate with threads 128 thereon. It is contemplated that the internal diameter of lance plate holes 120 is approximately equal to the inside diameter of lances 126. The lance plate 118 and body 110 are fitted into a manifold shield 130, which is made from a suitable low friction material, such as teflon-coated nylon. The manifold shield 130 is retained to the manifold body 110 by means of machine screws 132.

Referring back to FIG. 10, lances 126 are thereby removably attached and in fluid communication with manifold 108. Lances 126 have relatively thin walls and are manufactured from a high strength stainless steel or other suitable material. Lances 126, when mated with manifold 108, are approximately the length of housing 102. The lance assembly 100 further includes an indexing assembly 131, discussed further below, which is located approximately three to four feet from the end of the housing 102 which is proximate tube bundle "B" as shown in FIGS. 1 and 2.

The present invention is adapted to clean various heat exchanger tube bundles. It will be appreciated that the size of a heat exchanger tube and the manner in which the tubes are arranged within a tube bundle affect the required spacing between the tubes. Consequently, in order for the present invention to efficiently clean the interior of a heat exchanger tube bundle, it is necessary that the present invention be capable of adjustment for various tube sizes and spacing. The tube orientation within a tube bundle is generally either of a "square" or "triangular" pitch or alignment. Accordingly, it is necessary to align the lances 126 with the tube alignment. In order to accomplish this objective, the present invention includes an indexing assembly which is adapted to compensate for variations in tube size and orientation.

Referring now to FIGS. 17 and 18, the indexing assembly 131 includes a rearward indexing guide plate 132. The indexing guide plate 132 is mounted external and coaxial to housing 102 in a suitable mechanical manner. The guide plate 132 has a plurality of apertures 134 passing therethrough. The pattern formed by the guide plate holes 134 is similar to that found in lance plate 118 (see FIG. 14); however, guide plate holes 134 are of a sufficient diameter to permit lances 126 to pass through. Guide plate holes 134 are adapted to receive a plurality of guide tubes 136 which have sufficiently large internal diameter to permit lances 126 to pass through. Guide tubes 136 may be affixed to guide plate 132 in any suitable fashion. As shown, the guide tubes 136 are threaded and engage matching threads in guide plate holes 134. Guide tubes 136 are bent to alter the pattern or "pitch" and the spacing between adjacent tubes 136 to match that of the tubes within tube bundle "B." However, the angle of the bend along the centerline of guide tubes 136 is sufficiently small to permit lances 126 to pass through the guide tube 136 bend without unduly stressing the walls of, or plastically deforming, lances 126. A second forward guide plate 140A which is adapted to reflect either square or triangular pitch and tube diameter for the particular tube bundle "B" being cleaned is fitted between guide tubes 136. In FIG. 18 forward guide plate 140A is shown as having a square pitch and is further depicted in FIG. 19. The second guide plate 140A is retained about guide tubes by suitable mechanical means. As shown, guide plate 140A is retained by means of a strap clamp 142 which encircles plate 140A. FIG. 20 illustrates a forward guide plate 140B having a triangular pitch. Thus, the present invention may be readily adjusted for variations in tube bundle size and orientation in a relatively short period of time. Further, as guide tubes 136 are substantially parallel to the centerline of the housing 102, the centerline of lances 126 as they enter the tubes are substantially parallel to the axis of the tubes to be cleaned. Accordingly, lances 126 are less likely to be damaged during cleaning operations which call for the lances 126 to be offset from their original centerline.

Referring now to FIGS. 1, 2, 10, and 12 and with particular reference to FIGS. 10 and 12, the present invention also includes a spool assembly 200 for the storage of the high water pressure hose used to provide water under pressure to lances 126. Spool assembly 200 comprises a housing 202 which is removably fixed to lance housing 102 and support member 106. In the illustrated embodiment, spool housing 202 is secured to housing 102 by means of nuts and bolts 204. Rotatably mounted in spool housing 202 is spool 206. Spool 206 comprises a spindle 208, shaft 210, circumference plate 220 and side plates 222. Spool spindle 208 further includes a blind hole 211 therein along the longitudinal axis of spindle 208 and a radial passageway 212 therethrough. Blind hole 211 and radial passageway 212 are in fluid communication with each other. The radial passageway 212 is adapted to be removably connected to a water pipe 214 which is itself connected to union 216. Radial passageway 212 includes internal threads 213 adapted to sealingly mate with threads 215 on pipe 214. A high pressure water hose 218 is adapted to sealingly mate with union 216. The water hose 218 is a semi-rigid high pressure water hose capable of pressures in excess of 10,000 psi. A typical water pressure hose 218 would be Model 4025 ST or equivalent manufactured by Rogan-Shanley, Inc. of Houston.

As may be seen in FIG. 12, water hose 218 is reeled onto the spool 206 and is retained by spool circumference plate 220 and side plates 222. The hose 218 is but a single hose; it appears to be a double hose in FIG. 12 because it is wrapped twice around the spool since the view is taken along line 12—12 of FIG. 10. Hose 218 is retained by a plurality of fixed rollers 224 mounted within spool housing 202. As illustrated, the rollers 224 are rotatably mounted on pins 226 which are affixed to housing 202. Further, the surfaces of rollers 224 and plate 220 are angled to encourage the hose 218 to wrap around plate 220 in an adjacent manner rather than on top or otherwise tangle up. Thus, the hose 218 is reeled and retained about spool 206 without exceeding the minimum bend radius for hose 218. Affixed to spool spindle 208 is a rotating union 228 (FIG. 2) which is removably connected to union 230 which is itself connected to a high pressure water source through hose "H." Referring to FIGS. 1 and 10, coaxially affixed to spindle 208 is spool shaft 210. Mounted on spool shaft is a drive pulley 232. Mounted external to spool housing 202 is a hydraulic motor 234 having a drive pulley 236. Motor drive pulley 236 and spool drive pulley 232 are in rotational communication by means of drive belt 238. It is understood that the embodiment includes the use of drive gears and an endless chain to accomplish the transfer of rotational movement from motor 234 to spool 206. Further, motor 234 may be mounted external to spool housing 202 in a manner such that a motor drive gear would be in direct rotating contact with a drive gear mounted on spool shaft 210.

When hydraulic drive motor 234 is activated, the spool 206 is caused to rotate, thereby extruding or retracting hose 218. As may be seen in FIG. 10, hose 218 travels out of spool housing 202 and into the lance housing wherein it is removably connected to the manifold body 110 (FIG. 13). Thus, lances 126, manifold 108 and hose 218 are in fluid communication with each other. Further, as hose 218 is semi-rigid, it serves in the illustrated embodiment to advance and retract manifold 108, thereby advancing and retracting lances 126. Accordingly the illustrated embodiment provides for a common means of storing the high pressure water hose 218 and moving lances 126.

Figure 15:
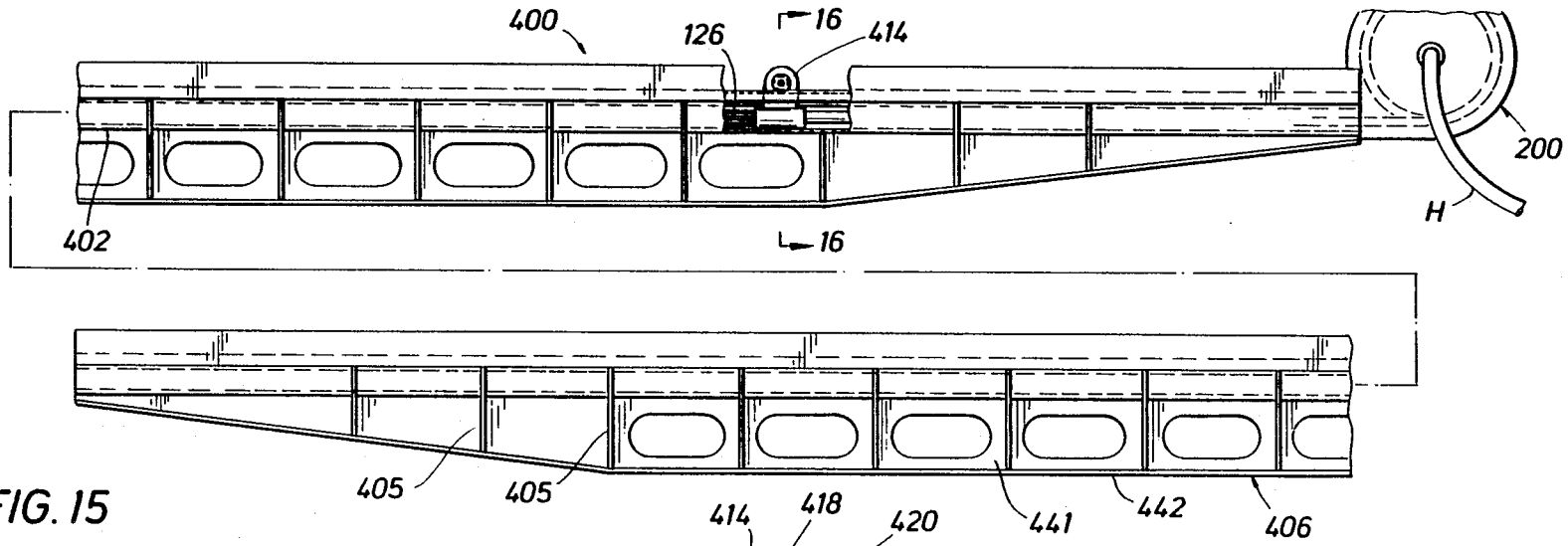
FIG. 15 is an elevational view partly in section of an alternate embodiment.
Figure 16:
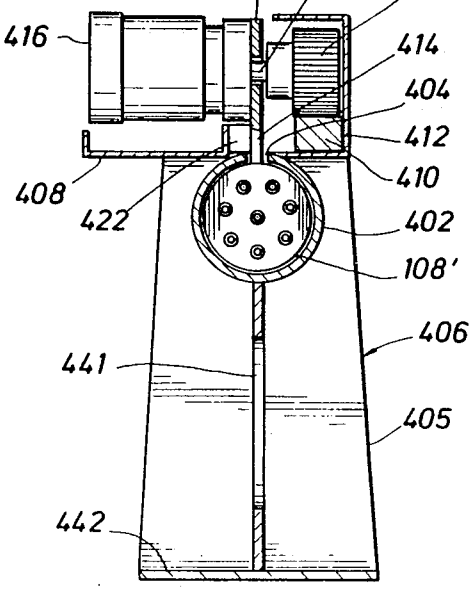
FIG. 16 is a cross-sectional view taken along line 16—16 of FIG. 15 showing the manifold transport mechanism of the alternate embodiment.

An alternate embodiment of the lance assembly 400 is illustrated in FIGS. 15 and 16. It is understood that the spool assembly 200 disclosed in the alternate embodiment utilizes a spool assembly 200 similar to that already disclosed. An elongate lance housing 402 having a longitudinal slot 404 along its length is mounted within an I-beam support member 406. A manifold 108′ similar to that disclosed in the preferred embodiment is slidably mounted within housing 402. A drive frame comprised of channel members 408 and 410 is mounted on carrier plate 414. A longitudinal drive gear rack 412 is mounted interior of drive frame member 410. Carrier plate 414 is affixed to manifold 108′ through support member 407. A hydraulic motor 416 having a drive shaft 418 and gear 420 are removably mounted on carrier 414. Further, an offset block 422 of a suitable low friction material such as nylon is removably mounted on carrier 414 and is in slidable contact with the flange of drive frame channel 408. When motor 416 is activated, the gear 420 engages drive rack 412, thereby moving manifold 108 through drive carrier 414. Further, block 422 ensures that gear 420 remains in rotating contact with drive rack 412.

As shown in FIGS. 15 and 16, housing 402 is braced by web 441, gussets 405 and flange 442 which provides rigidity and stability to the integrity of lance assembly 400.

It is understood that the details of lances 126 and indexing assembly 130 disclosed in the preferred embodiment are to be included in the alternate embodiment. Further, the alternate embodiment is also adapted to be mounted on carrier beam 362. Thus, either embodiment of the lance assembly 100 or 400 may be used equally well within the present invention.

OPERATION OF THE PRESENT INVENTION

Due to the weight and size of heat exchanger tube bundles, it is necessary to clean the tube bundles on site. Accordingly, it is necessary to transport the present invention to a job site for operations. The present invention including lance assembly 100, spool assembly 200 and positioning assembly 300 may be transported to the job site by any suitable means. It is contemplated that the present invention will be transported to a job site on a trailer as disclosed in U.S. patent application No. 07/489,001. Further, while the present invention may be used in conjunction with any high pressure, high volume fluid source, it is contemplated that the present invention will be used in conjunction with the invention disclosed and claimed in U.S. patent application No. 07/489,001.

Upon arriving at the job site, the positioner assembly 300 is removed from the trailer 22 by means of a crane assembly as disclosed in U.S. patent application No. 07/489,001 and positioned normal to the end of a tube bundle "B" to be cleaned. The remote control pendant 30 is removed from its transport vehicle and positioned to permit the operator to observe lancing operations while maintaining a safe distance from the high pressure lances. Flexible hydraulic lines are used to connect the hydraulic motors 342 to a suitable hydraulic pressure source. The motors 342 are then activated to lower guide frame 330. The lance housing 100 and spool housing 200 are then mounted on carriage beam 362 utilizing a suitable lifting and placement means, such as the crane disclosed in U.S. patent application No. 07/489,001 or any other suitable means. The lance and spool assemblies 100 and 200 are then secured to the carriage beam 362. The operator inspects the tube bundle spacing and selects the forward guide plate 140A/B which best corresponds with tube bundle size and spacing. The forward guide plate 140A/B is inserted around guide tubes 136, into mount 138 and secured with strap clamp 142.

A flexible hydraulic hose is used to interconnect the spool hydraulic drive motor 234 with a suitable hydraulic pressure source. The spool assembly is in communication with a high pressure water source by means of a hose H which is connected to union 230. The lances 126 are thus in fluid communication with the high pressure water source through hose 218 and manifold 108. The lance and spool assemblies 100 and 200 are then positioned with respeot to the tube bundle tubes by the selective application of hydraulic pressure to motors 324. Hydraulic pressure to spool drive motor 234 feeds out hose 218 and advances manifold 108 which in turn advances lances 126. The lances 126 advance out of the housing 102, through the first guide plate 132 and into the guide tubes 136. The lances 126 are thus indexed to the proper centerlines for individual tubes within tube bundle "B" when the lances exit forward guide plate 140A/B and enter tube bundle "B." The high pressure water source is activated by the operator causing the high pressure water to flow through hose H, hose 218, into manifold 108 and out lances 126 into the individual tubes. The lances 126 continue to advance into the tubes, cleaning deposits away from the inside. Should one of the lances 126 encounter an obstruction it is unable to clean away, the excess water pressure will be channeled into the remaining lances 126 through manifold 108 counterbore 116. Further, a commercial needle valve (not shown) may be placed in the hydraulic line powering hydraulic motor 234 to limit hydraulic pressure. When a lance 126 encounters an obstruction, if the water pressure or the forward motion of the lance 126 does not dislodge the obstruction, the needle valve will prevent the motor 234 hydraulic pressure from increasing. By limiting the pressure, the present invention prevents the lances 126 from buckling when attempting to clear the obstruction.

The present invention, when used in conjunction with a suitable means for supporting and rotating the tube bundle "B," such as that disclosed in U.S. patent application No. 07/489,001 is thus capable of cleaning the interior of all tubes within a tube bundle by positioning the lances vertically and horizontally. Further, a single operator is capable of positioning the lance and spool assemblies 100 and 200 and controlling the water flow from remote control pendant 30. Thus a single operator is capable of carrying out multi-lance cleaning operations.

Further, the present invention may be used independent of the positioning and support assembly 300. It is contemplated that the lance and spool assemblies 100 and 200 may be lifted and positioned vertically, by a crane, frame or other suitable mechanical means, permitting the lances 126 to project downward as they are advanced within the housing 102. Thus, lance and spool assemblies 100 and 200 may be used to clean tube bundles which, for reasons of size or weight, must be cleaned in a vertical position. Flexible hydraulic lines are connected to spool drive motor 234 to advance the hose 218, manifold 108 and lances 126 in the vertical position. Further, a flexible high pressure hose H may be used to provide a conduit for high pressure water.

The description given herein is intended to illustrate the preferred and alternate embodiments of the present invention. It is possible for one skilled in the art to make various changes to the details of the apparatus without departing from the spirit of this invention. Therefore, it is intended that all such variations be included within the scope of the present invention as claimed.

What is claimed is:

1. A multi-lance cleaning apparatus for cleaning the interior of heat exchanger tubes comprising:

an elongate hollow housing having first and second ends;

a hollow manifold slidably moveable within said housing, said manifold having a plurality of interconnected channels and outlets;

a conduit for connecting said manifold with a high pressure, high volume fluid source;

a spool for storage of said conduit to permit said conduit to advance and retract, said spool storage being in close proximity to said first end of said housing;

means for moving said manifold within said housing from a first retracted position to a second extended position;

a plurality of hollow tubular lances, the outer diameter of each said lance being adapted to fit within a heat exchanger tube, said lance having a first end and a second end, said first end of each said lance being removably attached to said manifold and in communication with said fluid source, said second end of said lance being in proximity to said second end of said housing, said lances moving in response to the movement of said manifold;

means for supporting and guiding the movement of said lances; and means for supporting and positioning said second end of housing and said second end of said lances with respect to a heat exchanger tube bundle to be cleaned.

2. The apparatus according to claim 1, wherein said apparatus further includes a semi-rigid, high pressure hose, one end of hose being adapted to be removably connected to said manifold, and the other end of said hose being adapted to be removably connected to a high pressure, high volume fluid source.

3. The apparatus according to claim 2, wherein said spool storage comprises:

a spool housing adapted to be removably connected to said elongate housing;

a spool rotatably mounted within said spool housing, said spool having a spindle, said spindle having a drive shaft on one end and a rotatable high pressure union mounted on the other end of said spindle, the other end of said hose being removably connected to said spool;

a plurality of idler rollers, said rollers being rotatably mounted within said housing and in proximity to said spool; and a means for rotating said spool.

4. The apparatus according to claim 3, wherein the means for rotating said spool comprises:

a drive gear mounted on the shaft of said spool spindle;

a hydraulic motor, said motor having an output shaft and a drive gear mounted thereon; and means for coupling the output of said hydraulic motor to said spool drive gear.

5. The apparatus according to claim 4, wherein said coupling includes an endless drive chain connecting said motor drive gear and said spool drive gear.

6. The apparatus according to claim 1, wherein said elongate housing further includes a support member mounted thereto.

7. The apparatus according to claim 6, wherein said moving means comprises:

a linear gear rack affixed to said support member;

said elongate housing further having a slot therein in proximity to said gear rack and running the length of said elongate housing;

a manifold adaptor, said adaptor having first and second ends and mounted slidably in said housing slot, said first end of said adaptor being affixed to said manifold;

a hydraulic motor having an output shaft and drive gear, said drive gear being in close proximity to and adapted to mate with said gear rack, said hydraulic motor further being removably attached to said second end of said manifold adaptor; and means for connecting said hydraulic motor to a hydraulic pressure source, the selective application of hydraulic pressure thereby causing said motor drive gear to index along said gear rack thereby indexing said manifold adaptor and said manifold.

8. The apparatus according to claim 1, wherein said support and guide means comprises:

a first guide plate having a plurality of apertures adapted to support said lances, said first guide plate being interposed proximate to said housing's second end;

a plurality of guide tubes, said guide tubes being removably attached to said first guide plate and radially offset from said first guide plate to permit said lances to pass therethrough; and a second guide plate having a plurality of apertures corresponding to the tube bundle to be cleaned and adapted to be removably mounted on said second end of said elongate housing.

9. A multi-lance cleaning apparatus for cleaning the interior of heat exchanger tube bundles comprising:

an elongate cylindrical hollow housing having first and second ends and a support member mounted thereto;

a hollow manifold slidably moveable within said housing, said manifold having a plurality of interconnected channels and outlets;

a semi-rigid high pressure water hose, having first and second ends, said first end being adapted to removably connect said manifold with a high pressure, high volume fluid source;

a spool for storage of said hose to permit said water hose to advance and retract;

a plurality of hollow tubular lances, the outer diameter of said lances being adapted to fit within a heat exchanger tube, said lance having a first end and a second end, said first end being removably attached to said manifold and in communication with said fluid source, said second end of said lance being in proximity to said second end of said housing; and means for supporting and positioning said second end of said housing and second first end of said lances with respect to a heat exchanger bundle to be cleaned.

10. The apparatus according to claim 9 wherein said apparatus further includes means for supporting and guiding the movement of said lances within said housing.

11. The apparatus according to claim 10 wherein said support and guide means comprises:

a first guide plate having a plurality of apertures adapted to support said lances, said first guide place being interposed proximate to said housing second end;

a plurality of guide tubes, said guide tubes being removably attached to said first guide plate and radially offset from said first guide plate to permit said lances to pass therethrough; and a second guide plate having a plurality of apertures corresponding to the tube bundle to be cleaned and adapted to be removably mounted on said second end of said elongate housing.

12. The apparatus according to claim 11, wherein said spool storage comprises:

a spool housing adapted to be removably connected to said elongate housing;

a spool rotatably mounted within said spool housing, said spool having a spindle, said spindle having a drive shaft on one end and a rotatable high pressure union mounted on the other end of said spindle, the second end of said hose being removably connected to said spool;

a plurality of idler rollers, said rollers being rotatably mounted within said spool housing and in proximity to said spool;

a drive gear mounted on the shaft of said spool spindle;

a hydraulic motor having an output shaft and a drive gear mounted on said shaft; and means for coupling the output of said hydraulic motor to said spool drive gear.

13. The apparatus according to claim 12, wherein said coupling means includes an endless drive chain for connecting said motor drive gear and said spool drive gear.

14. A multi-lance cleaning apparatus for cleaning the interior of vertically oriented heat exchanger tubes comprising:

an elongate hollow housing having first and second ends;

a hollow manifold slidably moveable within said housing, said manifold having a plurality of interconnected channels and outlets;

a conduit for connecting said manifold with a high pressure, high volume fluid source;

a spool for storage of said conduit to permit said conduit to advance and retract, said spool storage being in close proximity to said first end of said housing;

means for moving said manifold within said housing from a first retracted position to a second extended position;

a plurality of hollow tubular lances, the outer diameter of each said lance being adapted to fit within a heat exchanger tube, said lance having a first end and a second end, said first end of each of said lances being removably attached to said manifold and in communication with said fluid source, said second end of said lance being in proximity to said second end of said housing, said lances moving in response to the movement of said manifold;

means for supporting and guiding the movement of said lances; and means for vertically suspending said housing and spool storage above the heat exchanger tubes, such that said lances may be selectively advanced down into the heat exchanger tubes.

15. The apparatus according to claim 14, wherein said apparatus further includes a semi-rigid, high pressure hose, one end of hose being adapted to be removably connected to said manifold, and the other end of said hose being adapted to be removably connected to a high pressure, high volume fluid source.

16. The apparatus according to claim 15, wherein said spool storage comprises:

a spool housing adapted to be removably connected to said elongate housing;

a spool rotatably mounted within said spool housing, said spool having a spindle, said spindle having a drive shaft on one end and a rotatable high pressure union mounted on the other end of said spindle, the other end of said hose being removably connected to said spool;

a plurality of idler rollers, said rollers being rotatably mounted within said housing and in proximity to said spool; and a means for rotating said spool.

17. The apparatus according to claim 16, wherein the means for rotating said spool comprises:

a drive gear mounted on the shaft of said spool spindle;

a hydraulic motor, said motor having an output shaft and a drive gear mounted thereon; and means for coupling the output of said hydraulic motor to said spool drive gear.

18. The apparatus according to claim 17, wherein said coupling includes an endless drive chain connecting said motor drive gear and said spool drive gear.

19. The apparatus according to claim 14, wherein said elongate housing further includes a support member mounted thereto.

20. The apparatus according to claim 14, wherein said support and guide means comprises:

a first guide plate having a plurality of apertures adapted to support said lances, said first guide plate being interposed proximate to said housing's second end;

a plurality of guide tubes, said guide tubes being removably attached to said first guide plate and radially offset from said first guide plate to permit said lances to pass therethrough; and a second guide plate having a plurality of apertures corresponding to the tube bundle to be cleaned and adapted to be removably mounted on said second end of said elongate housing.

21. The apparatus according to claim 14 wherein the means for vertically suspending said housing and spool storage above the heat exchanger tubes includes a mobile crane.

* * * * *